US010035646B2

(12) United States Patent
García Lopez et al.

(10) Patent No.: US 10,035,646 B2
(45) Date of Patent: Jul. 31, 2018

(54) SYSTEM FOR JOINING CONTAINERS

(71) Applicant: Effective Seaborne Engineering Solutions, S.L., Madrid (ES)

(72) Inventors: Jesús García Lopez, Pineda de Mar (ES); Juan A. Ureta Perez, Algeciras (ES); Francisco José Aguilar Ferrer, Pineda de Mar (ES)

(73) Assignee: Effective Seaborne Engineering Solutions, S.L., Madrid (ES)

( * ) Notice: Subject to any disclaimer, the term of this patent is extended or adjusted under 35 U.S.C. 154(b) by 0 days.

(21) Appl. No.: 15/516,421

(22) PCT Filed: Oct. 8, 2015

(86) PCT No.: PCT/ES2015/070733
§ 371 (c)(1),
(2) Date: Apr. 3, 2017

(87) PCT Pub. No.: WO2016/055684
PCT Pub. Date: Apr. 14, 2016

(65) Prior Publication Data

US 2017/0313502 A1 Nov. 2, 2017

(30) Foreign Application Priority Data

Oct. 8, 2014 (ES) ..... 201431480

(51) Int. Cl.
*B65D 88/12* (2006.01)
*B65D 90/00* (2006.01)
(Continued)

(52) U.S. Cl.
CPC ..... *B65D 90/0006* (2013.01); *B65D 88/022* (2013.01); *B65D 88/121* (2013.01);
(Continued)

(58) Field of Classification Search
CPC .... Y10T 24/28; B65D 90/0006; B65D 90/48; B65D 90/04; B65D 90/008; B65D 88/022; B65D 88/027; B65D 88/121
See application file for complete search history.

(56) References Cited

U.S. PATENT DOCUMENTS

2010/0018088 A1* 1/2010 Rajpal ..... A45C 13/42 40/5
2012/0181270 A1 7/2012 Smith

FOREIGN PATENT DOCUMENTS

DE 19639903 4/1998
WO WO 2006/019929 2/2006
(Continued)

OTHER PUBLICATIONS

Translation of DE19639903 A1 retrieved from ESPACENET Dec. 20, 2017 (Year: 2017).*
(Continued)

*Primary Examiner* — Robert John Sandy
*Assistant Examiner* — Michael S Lee

(57) ABSTRACT

System for joining containers for a first container (1) with doors at the front and rear thereof and a second container (2) with at least one door at the rear thereof, attached by the smaller sides, which comprises four hooks (3) on the four corners of the containers (1, 2), a plurality of sheets (4, 5) on the interior edge at the rear of the containers (1, 2) fixable to both and which cover the entire interior perimeter of the containers (1, 2), and means for adjusting the identification number of the containers (1, 2).
The means for adjusting the identification number can comprise a series of electronic screens (101, 102) on each container (1, 2) with two control units (102, 202), power sources, and communication means between the control
(Continued)

units (102, 202) and optionally a contact (103, 203) in the support area of a sheet (4, 5).

9 Claims, 2 Drawing Sheets

(51) Int. Cl.
*B65D 88/02* (2006.01)
*B65D 90/04* (2006.01)
*B65D 90/48* (2006.01)

(52) U.S. Cl.
CPC ..... *B65D 90/008* (2013.01); *B65D 90/04* (2013.01); *B65D 90/48* (2013.01); *Y10T 24/48* (2015.01)

(56) References Cited

FOREIGN PATENT DOCUMENTS

| | | |
|---|---|---|
| WO | WO 2012/041299 | 4/2012 |
| WO | WO 2014/018566 | 1/2014 |
| WO | WO 2016/055684 | 4/2016 |

OTHER PUBLICATIONS

International Search Report and the Written Opinion dated Dec. 22, 2015 From the International Searching Authority Re. Application No. PCT/ES2015/070733 and Its Translation Into English. (13 Pages).

* cited by examiner

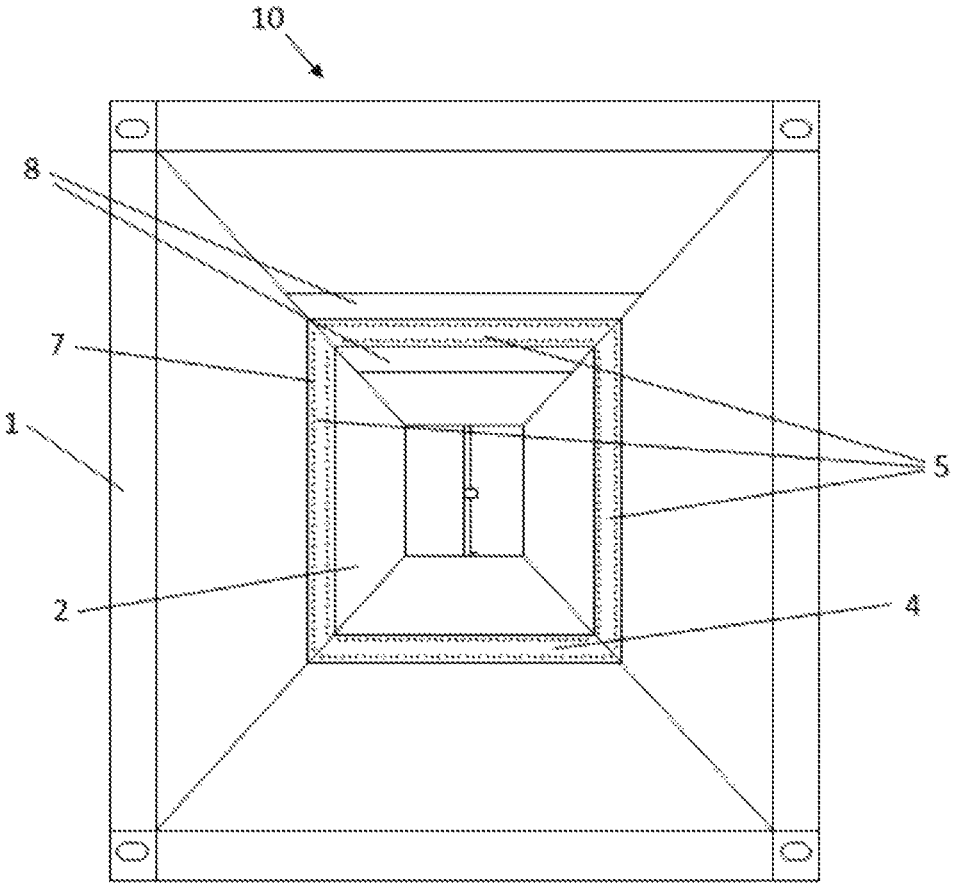
Figure 2
Figure 3
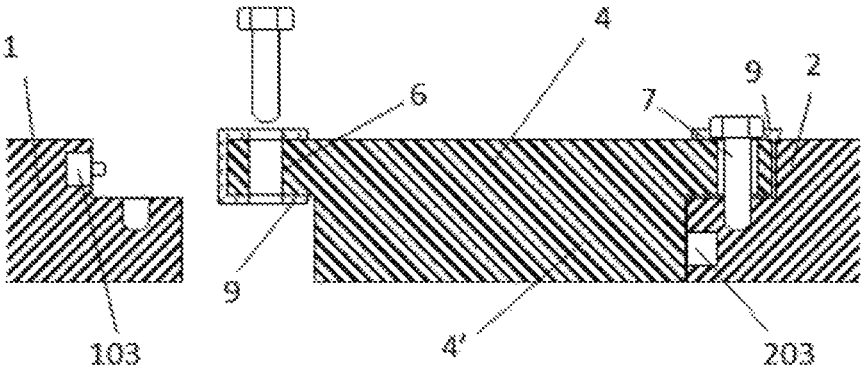

SYSTEM FOR JOINING CONTAINERS

RELATED APPLICATIONS

This application is a National Phase of PCT Patent Application No. PCT/ES2015/070733 having International filing date of Oct. 8, 2015, which claims the benefit of priority of Spanish Patent Application No. P201431480 filed on Oct. 8, 2014. The contents of the above applications are all incorporated by reference as if fully set forth herein in their entirety.

TECHNICAL SECTOR

The present invention relates to a system for joining containers, of the standard type, in order to allow the conversion of two containers of small sizes into one container of a larger size, with all the required mechanical properties.

It is for use in the field of logistics and transport.

FIELD AND BACKGROUND OF THE INVENTION

Multimodal containers are known in the prior art, normally according to the standards ISO 6346 or EN 13044. These have standard measurements (normally of 8, 10, 20, 30 and 40 feet long) and comprise a rectangular prismatic polyhedron lying down, with two larger sides, a roof and a base and two smaller sides, which are termed front and rear. A typical container normally only has one entry located at the rear.

These containers require means for fixing with the surface of the transport means (truck or ship) or with one or more adjacent containers. To this end, they are defined into the 8 special vertex pieces (corner posts), likewise standard, where they hook the fixing means. The most common fixing means are known in the sector as twistlock and an example can be seen in the U.S. Pat. No. 6,363,586 which is incorporated into this application by reference.

These hooks or fixing means only serve to avoid undesired movements of the container (which in the case of a ship can even cause the sinking of the same) and they are slightly limited in terms of the possibility for working with two containers joined. If the joining is sufficiently resistant to maintain them in position, it is not sufficient to load two joined containers and work with these as it they were only one container with double length.

Likewise, this joining does not allow the two containers to share the loading space, leaving the interior remaining protected from weathering and unauthorized access (principally for theft).

The applicant does not know any solution to these problems, similar to the invention.

SUMMARY OF THE INVENTION

The invention consists of a system for joining containers according to the claims, which, in the different embodiments thereof, resolves the problems of the prior art.

The system for joining containers of the invention is applicable to a first container with doors at the front and rear thereof and a second container with at least one door at the rear thereof, attached by two smaller sides. In the case of having a second door, at the front, this will preferably be lockable in a closed position from the interior. The common door will preferably be superimposable on the roof and lockable in this position so that it does not affect the loading space or the useful section.

The system comprises four hooks in the four corners of the containers, like for example the previously cited (U.S. Pat. No. 6,363,586). It also comprises a plurality of sheets on the interior edge of the rear of the containers, fixable to both, and which cover the entire interior perimeter of the containers. Furthermore, it comprises means for adjusting the identification number of the containers.

These means for adjusting the identification number can be in various forms, but preferably comprise a series of electronic screens on each container, with two control units (one per container is sufficient), power sources and communication means between the control units of the two containers (by cabling or wireless).

Associated with these communication means, each container preferably comprises a contact on the interior edge, normally on the roof of the container to avoid accidental impacts which is activated with the placement of the sheets and indicates to the control unit that the joining of the two containers has been established.

In order to implement the communication by cabling, provision can be made for a sheet to have connectors on both longitudinal edges, electrically connected, and the containers have, in turn, the complementary connectors connected to the corresponding control unit. In this way, the communication circuit is closed between the two with the placement of the sheet.

A much more rudimentary alternative for the connectors would be for the connection to be implemented by cabling, with direct joining, not by the sheets, of the two cables which hang from the roof.

In order to increase the impermeability of the resulting container, the sheets can have a seal on the part which contacts with the internal edges of both containers. It is preferably provided along the longitudinal edges.

The system has been defined in particular for 20 foot long containers (6.058 m), joined into one 40 foot long container, but it is applicable to other measurements.

BRIEF DESCRIPTION OF THE SEVERAL VIEWS OF THE DRAWINGS

In order to better understand the invention, the following figures are included.

FIG. 2 represents a schematic view of the interior of a container resulting from the joining of two containers, according to a second example.

FIG. 3 shows a section of a detail of the lower sheet and the two containers. A tightened contact can be seen therein and a second contact without tightening because the corresponding container has not yet been joined.

DESCRIPTION OF SPECIFIC EMBODIMENTS OF THE INVENTION

Figure 1:
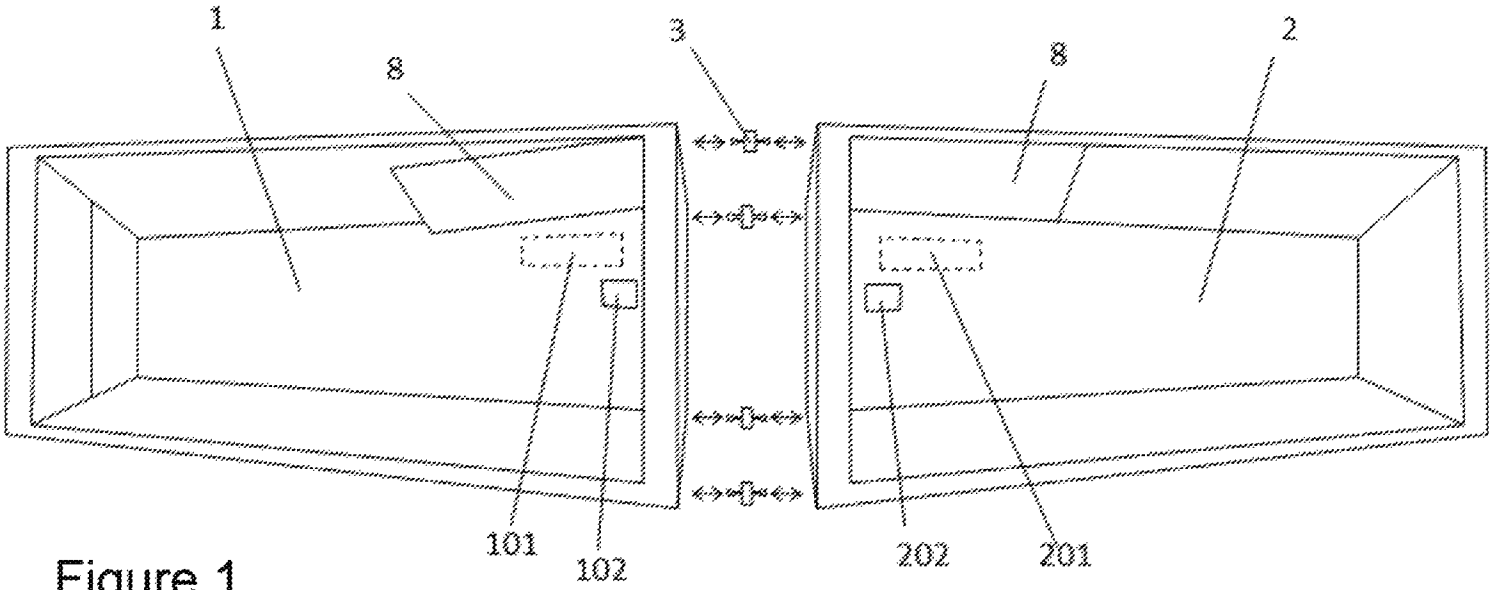
FIG. 1 represents a diagram of the connection between two containers (from which one side has been removed to better observe the interior) according to an exemplary embodiment. One of the superimposable doors is not in the final position thereof, but halfway to said position.

Below an embodiment of the invention will be briefly described, as an illustrative and non-limiting example thereof.

The invention relates, according to the embodiments of the figures, to a system for joining containers which allows the joining of two standard containers (whether ISO or EN) into one container with increased length, normally double. It is envisaged, in particular for 20 foot long containers (20' or 20'HC, of a measurement of 6.058 m), which can be grouped in pairs into one 40 foot long container (12.192 m) thanks to the invention, maintaining the same mechanical behavior, but it can be applied to other sizes, although the result will not be standard.

The invention departs from a first container (1) which must have doors at the front and the rear and a second container (2) which can have doors only at one end (the rear) or at the two ends. At least one door of each container (1, 2) should be able to be locked in an open position, and preferably against the roof of the container (1, 2) as can be observed in the FIGS. 1 and 2 so that it does not affect the usefulness of the container resulting (10) from the joining.

The containers (1, 2) are preferably identical and comprise a standard door at one end, the rear, and a door (8) which is superimposable and lockable on the roof at the front. The door at the rear of a container (1, 2) is completely lockable from within, preferably so that the resulting container (10) can be provided with a single useful door. The superimposable door will preferably only be actuatable from the interior of the container (1, 2) in order to be able to ensure the integrity of the load since it can only be opened when it is empty.

It is recommendable for the containers (1, 2) to be designed such that narrowing is not produced in the area of the superimposable door (8) so that once joined, the section is constant over the entire resulting container (10). This modification would be of greater importance in the so-called "corner post".

These two containers (1, 2) are joined at the corners thereof by means of four hooks (3), twistlocks, like for example in the U.S. Pat. No. 6,363,586 previously cited. This hook (3) is preferred since it has a very good mechanical resistance and resistance to accidental unhooking, but the invention is not limited to this type and model, being applicable to other hooks which meet the starting conditions.

The joining of two containers (1, 2) attached by means of these hooks (3) leaves a space which forms a discontinuity in the floor and walls. Therefore, it should be closed so that the resulting container (10) has the required mechanical properties. To this end, the invention comprises a series of sheets (4, 5), normally between 4 and 6, to close these spaces from within. These sheets (4, 5) have means for joining to the interior of the containers (1, 2) such as a plurality of through-holes (6) for the introduction of two screws (7) through the holes of the sheets (4, 5) and into bores implemented in the internal edge of the containers (1, 2). The sheets (4, 5) can be the same as each other, flat, or have the shape which is considered most appropriate: an L-shape, combinations of flat and U-shape, etc. It is recommended for them to be flat so that they do not occupy too much volume when they are not in use.

The lower sheet (4) normally has a central thickened portion (4') (FIG. 3) along the entire or almost the entire length thereof in order to aid the resistance of the resulting container (10). This thickened portion (4') is placed between both containers, orientated towards the exterior, preventing the torque opening the joining through the center. A similar thickened portion (4') can be situated in the upper sheet (or in the rest of the sheets) if it is considered necessary.

The sheets (4, 5) can normally be implemented in the same material as the containers (1, 2) or the principal elements thereof (corner post, . . . ) or others with equivalent characteristics, consequently they are implemented in corten steel or other similar materials.

The sheets (4, 5) carry out mechanical resistance functions, completing the resistance which the hooks (3) do not finish providing, but equally can carry out functions for sealing the resulting container (10) so that the load is not damaged. To this end, a seal (9) can be provided which contacts the internal edges of both containers (1, 2). The seal can cover the entire base of the sheets (4, 5) or only the longitudinal edges thereof, for example completely surrounding the edge (FIG. 3). A suitable material for this seal (9) can be rubber.

Therefore, it is necessary for the containers (1, 2) to have an adaptation on the internal edge thereof at the side, the doors thereof are locked. This adaptation corresponds to the form of the fixing of the sheets (4, 5) and in the cited example will be threaded bores. Similarly, it can be rods which pass through the holes (6) such that only nuts are left to be applied instead of screws (7).

This joining of both containers (1, 2) by means of strongly anchored sheets (4, 5), allows the container to be completely rigid and can support a weight similar to that which one standard container of the size of the resulting container (10) allows.

Part of the invention corresponds to the automatic adjustment of the numeration of the resulting container (10). Legislation obliges that each container have a unique identification (letters of the owners, type of code according to the standard, numeration and check digit), consequently a container formed by two smaller containers cannot preserve the numeration on both halves.

For this, the system should comprise means for adjusting the numeration. A first solution is manual, with plates where the numeration is written and which are changed when the joining or separation of the two containers (1, 2) is carried out. Each container (1, 2) should have various plates with the numeration of an eventual resulting container (10) in the case of joining with another container (1, 2) and can "loan" the other numeration thereof to the other container.

However, the invention prefer for each container (1, 2) to have a series of screens (101, 201), for example LED or LCD, where the registration number of the container is situated. The screens (101, 201) are placed where the legislation requires the numeration of the container (1, 2) to be displayed, although in FIG. 1 only one per container (1, 2) is represented.

These screens (101, 201) have the power supply thereof (not shown) and can be provided with manual inputs for the new code or two control units (102, 202) with a communication system between the two, wireless or with cabling. On these screens (101, 201), the registration numbers can also be provided by means of bar codes or QR codes or any other which is required and common in logistics.

In this way, the codes, which each container (1, 2) has reserved, can be communicated for the cases of joining containers (1, 2), which do not match, and the control units (102, 202) can select the code which the screens (101, 201) show. The selection criteria among the two container codes can give priority to the lowest or highest numeration, which an operator, etc preselects.

The change of numeration should be automatic when it detects that the two containers (1, 2) have been connected or disconnected, consequently one contact (103, 203) can be provided in the position area of one of the plates (4, 5) such that the mere placing or separation of the plate informs the control units (102, 202) of the need to change numeration. This same plate (4, 5) can comprise two connectors and internal cabling to implement the communication by cable between the two control units (102, 202). In this case, the contact (103, 203) informs the control units (102, 202) which should search for the new number wirelessly. In FIG. 3, two position examples are shown, applied to the lower sheet (4), although they are preferably situated in the roof of the containers to avoid accidental impacts.

When the containers (1, 2) are provided with connectors which are joined to each other, whether by way of the sheet (4, 5) or otherwise, the mere joining of the two connectors is sufficient to signal to the control units (102, 202) that two containers (1, 2) have been joined and that therefore the numeration must change, thus the circuit is closed, although the contact (103, 203) can be maintained as a redundant measure.

The screens (101, 201) are only accessible from the interior of the container (1, 2) by authorized personnel. The change of numeration is only possible following the joining of the containers (1, 2) to form only one container. The disconnection of the containers (1, 2), in turn, causes the return to the original numeration thereof.

The normal manner of operation is initiated with the opening of the superimposable doors (8) and the locking in the open position thereof. Similarly, one of the other doors is opened in order to allow free access. As required, the other door is locked inside, which is going to be the "front" of the resulting container (10).

The four hooks (3) are placed, as is known, until the two containers (1, 2) are joined and the sheets (4, 5) are installed. With the placing of the sheets (4, 5) or the assembly of the connectors, the system automatically recognizes that the joining has been implemented and changes the numeration on all the corresponding screens (101, 201) by itself. If the system is not automatic, the numeration is changed manually.

What is claimed is:

1. A system for joining containers applicable to a first container (1) with doors at the front and rear thereof and a second container (2) with at least one door at the rear thereof, attached by the smaller sides, so that a resulting container (10) from coupling of first and second containers (1, 2) is obtained, characterized in that it comprises:

four hooks (3) applicable on the four corners of the containers (1, 2) for joining both containers (1, 2);

a plurality of sheets (4, 5) applicable on the interior edge at the rear of the first and second containers (1, 2) fixable to both and which cover an entire interior perimeter of the first and second containers (1, 2);

a series of electronic screens (101, 201) for adjusting identification numbers of the containers (1, 2) to adjust an identification number of a resulting container (10), wherein the plurality of sheets (4, 5) have a seal (9) on the part which contacts the internal edges of both containers (1, 2) and the series of electronic screens (101, 201) are on the first and second container (1, 2), together with control units (102, 202), power sources; and a contact (103, 203) on the interior edge of each container (1, 2) which is activated with the placement of the plurality of sheets (4, 5) and indicates to a respective control unit from the control units (102, 202) the joining of first and second containers (1, 2);

wherein the control units (102, 202) which are respectively on each of the first and second containers (1, 2) communicate with one another.

2. The system according to claim 1, wherein the contacts (103, 203) are on the roofs of the containers (1, 2).

3. The system according to claim 1, wherein the control units (102, 202) wirelessly communicate with one another.

4. The system according to claim 1, further comprising has a connector on each container (1, 2) the connector being connected to the control unit (102, 202) and couplable on the opposing connector.

5. The system according to claim 1, wherein the seal (9) is provided on the longitudinal edges of the sheets (4, 5).

6. The system according to claim 1, wherein the door at the rear of each container (1, 2) is superimposable and lockable on the roof of the same.

7. The system according to claim 1, wherein the door at the front of at least one container (1, 2) is lockable from the interior.

8. The system according to claim 1, wherein the containers (1, 2) are 20-foot (6.058 m) containers.

9. The system according to claim 1, wherein at least one of the sheets (4, 5) has a central thickened portion (4').

* * * * *